US009599339B2

(12) United States Patent
Kristensen et al.

(10) Patent No.: US 9,599,339 B2
(45) Date of Patent: Mar. 21, 2017

(54) MOTOR-DRIVEN CHIMNEY DRAFT SYSTEM AND AN IMPELLER FOR USE IN THE SYSTEM

(71) Applicant: exodraft a/s, Odense SO (DK)

(72) Inventors: Jesper Hojer Kristensen, Odense SV (DK); Kurt Pedersen, Langeskov (DK)

(73) Assignee: EXODRAFT A/S, Odense SO (DK)

( * ) Notice: Subject to any disclaimer, the term of this patent is extended or adjusted under 35 U.S.C. 154(b) by 883 days.

(21) Appl. No.: 13/673,694

(22) Filed: Nov. 9, 2012

(65) Prior Publication Data

US 2013/0130605 A1 May 23, 2013

(30) Foreign Application Priority Data

Nov. 18, 2011 (EP) ..... 11189675

(51) Int. Cl.
*F23L 17/02* (2006.01)
*F23L 17/00* (2006.01)
*F04D 25/06* (2006.01)

(52) U.S. Cl.
CPC ..... *F23L 17/005* (2013.01); *F04D 25/06* (2013.01); *F23L 17/02* (2013.01)

(58) Field of Classification Search
CPC ..... F23L 17/005; F04D 25/082
USPC ..... 110/162
See application file for complete search history.

(56) References Cited

U.S. PATENT DOCUMENTS 2,242,278 A * 5/1941 Yonkers, Jr. ..... A47L 9/125 15/327.6
2,300,578 A * 11/1942 Newton ..... F23L 17/00 110/162
2,658,665 A * 11/1953 Tschudy ..... A47L 5/22 417/366
3,401,624 A * 9/1968 Mohrman ..... F24F 7/025 454/344
3,782,303 A * 1/1974 Pfister ..... F23L 17/00 110/162
4,200,035 A * 4/1980 Zaniewski ..... F23L 17/005 454/15

(Continued)

FOREIGN PATENT DOCUMENTS

EP 0 053 703 A2 6/1982

*Primary Examiner* — Steven B McAllister
*Assistant Examiner* — Jonathan Cotov
(74) *Attorney, Agent, or Firm* — Bryan D. Zerhusen; Locke Lord LLP

(57) ABSTRACT

Impeller for a motor-driven chimney draft system, comprising a flue gas impeller (10) for creating, in a flue gas passage, a draft in a flue gas downstream direction. A flue gas deflector disk (20) is situated downstream relative to the flue gas impeller (10) and connected to the flue gas impeller (10); and a hub for connecting the impeller to an end portion of a driving shaft of a motor (100), wherein the hub and the end portion of the driving shaft, when connected, are both situated downstream relative to the flue gas deflector disk (20), the hub indirectly connected to the flue gas deflector disk (20) by means of intermediate members. Advantageously the intermediate members are impeller blades (40) connected to the downstream side of the flue gas deflector disk (20) and to a venting disk (30) with venting holes (31, 32) so as to form a turbine.

18 Claims, 3 Drawing Sheets

(56) References Cited

U.S. PATENT DOCUMENTS 4,236,443 A 12/1980 Schossow
4,342,258 A * 8/1982 Zaniewski ..... F23L 17/005 454/16
4,344,370 A * 8/1982 Smith ..... F23L 17/005 110/162
4,641,571 A * 2/1987 Anderson ..... F24F 7/025 454/19
4,757,802 A * 7/1988 Guzorek ..... F23L 17/04 110/162
4,759,272 A * 7/1988 Zaniewski ..... F23L 17/005 110/162
5,070,772 A * 12/1991 Guzorek ..... F23L 17/005 110/162
5,110,266 A * 5/1992 Toyoshima ..... A47L 5/22 415/119
5,375,651 A * 12/1994 Colwell ..... F04D 25/082 110/162
5,669,811 A * 9/1997 Zaniewski ..... F23L 17/005 454/16
5,839,374 A * 11/1998 Conner ..... F04D 23/001 110/162
6,296,478 B1 10/2001 Gatley, Jr.
6,352,473 B1 * 3/2002 Clark ..... F23L 17/10 454/18
6,450,874 B2 * 9/2002 Hoyez ..... F23L 17/005 110/162
6,488,475 B2 * 12/2002 Murata ..... A47L 5/22 417/32
6,602,058 B1 * 8/2003 Stewart ..... F04D 25/082 417/366
6,769,425 B1 8/2004 Kim
6,951,241 B1 * 10/2005 Gatley ..... F04D 25/082 126/110 A
6,966,830 B2 * 11/2005 Hurlstone ..... B60H 1/00471 417/363
7,320,636 B2 * 1/2008 Seliger ..... B08B 15/002 126/299 F
2001/0038794 A1 * 11/2001 Stewart ..... F23L 17/005 417/53
2012/0174878 A1 * 7/2012 English ..... F23L 17/005 122/18.4

* cited by examiner

MOTOR-DRIVEN CHIMNEY DRAFT SYSTEM AND AN IMPELLER FOR USE IN THE SYSTEM

CROSS-REFERENCE TO RELATED APPLICATIONS

This application claims priority to European Patent Application No. 11189675.9, filed Nov. 18, 2011, the entire contents of the aforementioned application is hereby incorporated herein by reference.

FIELD OF THE INVENTION

The invention relates to motor-driven chimney draft systems for providing forced draft through a chimney in situations where the thermally induced draft is insufficient. The forced draft increases the flow of flue gases which are removed from a furnace, a stove or other fireplace, which in turn draws fresh air into the furnace to support the combustion.

BACKGROUND OF THE INVENTION

A chimney draft system can, in principle, be located anywhere in the flow path of the flue gases from the flue gas outlet of the fireplace to the outlet end of the chimney. It is common to arrange a chimney draft system at the outlet end of the chimney, where the temperature of the flue gases is the lowest, and it will often be possible and relatively simple to retrofit a chimney draft system at this location. Flue gases can be very hot, and although some cooling will take place on their way from the fireplace to the outlet of the chimney, the flue gases can still be hot when leaving the outlet of the chimney. Chimney draft system including its motor must therefore be constructed to operate at elevated temperatures caused by the flue gases.

EP 0 053 703 discloses a chimney draft system with an impeller, for mounting at the flue gas outlet of a furnace. U.S. Pat. No. 4,236,443 discloses a chimney draft system for mounting directly above the chimney mouth. Each of these systems has a motor with a motor shaft carrying an impeller at its distal end, and the distal end of the motor shaft will come into contact with the hot flue gases, and heat will be conducted through the motor shaft to the motor whereby the motor will be heated. Motors need to be constructed to resist such heating which makes the motors more expensive.

It is an object of the invention to provide an impeller for a motor-driven chimney draft system which reduces the heat transfer from the hot flue gases in the chimney to the motor.

SUMMARY OF THE INVENTION

The invention meets this object by providing an impeller comprising a flue gas impeller for creating, in a flue gas passage, a draft in a flue gas downstream direction, a flue gas deflector disk for deflecting the flue gas, the flue gas deflector disk situated downstream relative to the flue gas impeller and connected to the flue gas impeller, a hub for connecting the impeller to an end portion of a driving shaft of a motor, wherein the hub and the end portion of the driving shaft, when connected, are both situated downstream relative to the flue gas deflector disk, the hub indirectly connected to the flue gas deflector disk by means of intermediate members.

With such an impeller the driving shaft of the motor can be prevented from contacting the hot flue gases. Due to the intermediate members indirectly connecting the hub and the flue gas deflector disk the transmission path for heat from the flue gases to the driving shaft of the motor can be made long and with a relatively small cross section, i.e. the path is narrow, which significantly increases the thermal resistance of the path In comparison to the prior art.

In an advantageous embodiment the intermediate members comprise impeller blades which function to draw fresh air towards the flue gas deflector disk and thereby provide active cooling.

In a further advantageous embodiment a venting disk with venting holes therein is arranged at the downstream side (the cold side) of the flue gas deflector disk and at a distance therefrom so as to define a space between the flue gas deflector disk and the venting disk. The impeller blades are situated in this space and are advantageously connected both to the flue gas deflector disk and to the venting disk such as to form a turbine wheel that can draw fresh air from the downstream side, i.e. the cold side, of the flue gas deflector disk and through the venting holes into the space between the flue gas deflector disk and the venting disk where the impeller blades will force the air out in a radial direction and thereby provide cooling of the flue gas deflector disk and other components in contact with the air, in particular the driving shaft of the motor, and also provide an insulating layer of air The flue gas deflector disk keeps the flue gases separated from the air that is drawn in as cooling air, and it is therefore preferred that the flue gas deflector disk is as large as possible in order to ensure that the cooling air is transported to the ambient of the device without mixing with the flue gases. It is preferred that the flue gas deflector disk has a larger diameter than the venting disk.

The flue gas impeller can be an axial impeller or a centrifugal impeller or any other type of impeller that is suitable for creating a draft in a flue gas passage. A centrifugal flue gas impeller can have its impeller blades mounted on the upstream side (the hot side) of the flue gas deflector disk.

A motor-driven chimney draft system according to the invention system comprises an impeller according to the invention and a motor with a driving shaft, wherein an end portion of the driving shaft is connected to the hub. In this construction the driving shaft of the motor does not come into contact with the hot flue gases and heat transmitted through the motor shaft will consequently be reduced in comparison to the prior art.

According to the invention a chimney draft system may further comprise a plate fixed to the motor and situated between the motor and the impeller, where the motor-bearing plate has a central opening receiving the driving shaft, and one or more openings allowing fresh air to flow through the openings towards the impeller. The openings can be arranged so that the flow of air is directed to where there is a need for cooling. In particular, a central opening in the plate that is fixed to the motor can direct the air flow around the motor shaft to provide cooling to the motor shaft.

In situations where the thermally induced draft is sufficient the motor can be inactivated, and the thermally induced draft will then drive the flue gas impeller in rotation, whereby also the turbine formed by the flue gas deflector disk and the venting disk with impeller blades will rotate and force fresh air past the motor and its driving shaft.

DETAILED DESCRIPTION OF THE INVENTION

Figure 1:
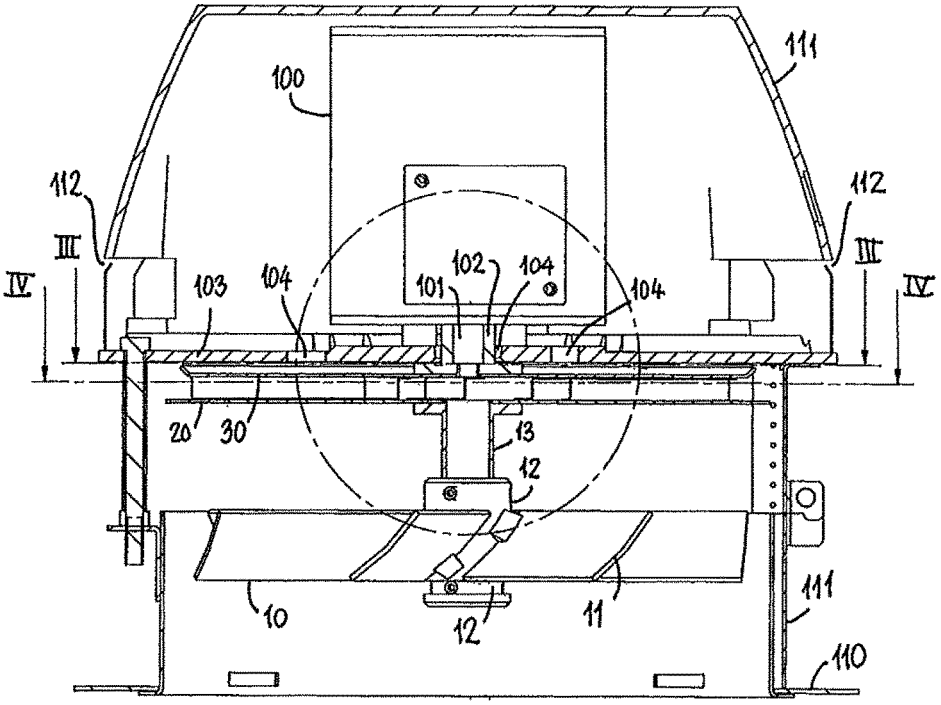
FIG. 1 shows a longitudinal section through a motor-driven chimney draft system having an impeller acceding to the invention.
Figure 2:
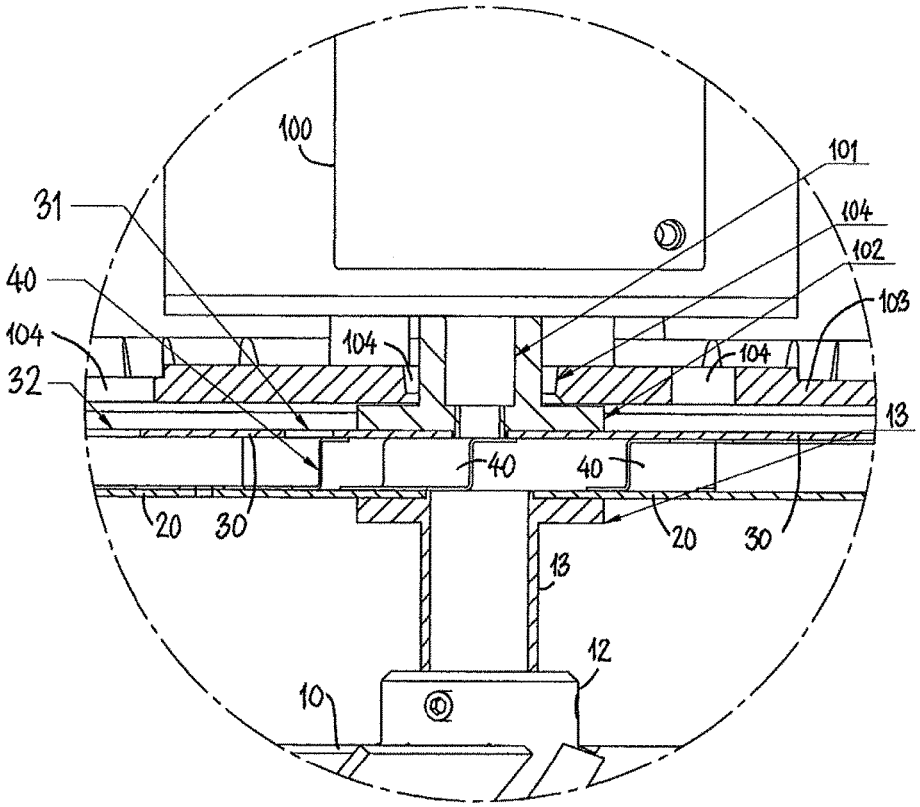
FIG. 2 shows the central portion of FIG. 1 on a larger scale.
Figure 3:
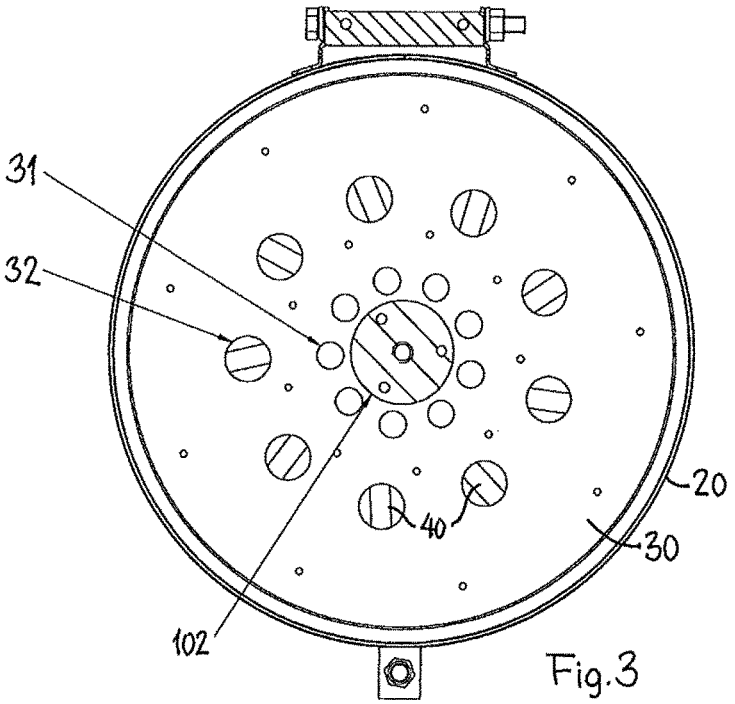
FIG. 3 shows a cross section through the system in FIG. 1 along the line III-III.
Figure 4:
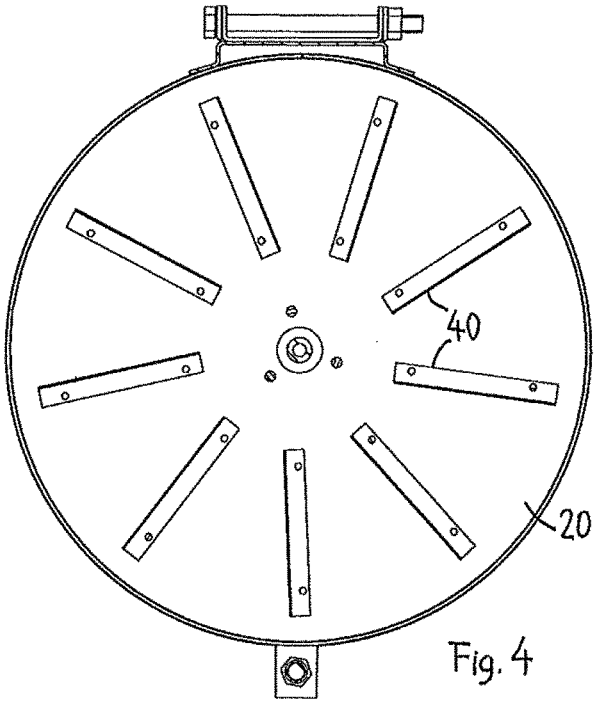
FIG. 4 shows a cross section through the system in FIG. 1 along the line IV-IV.

In FIGS. 1 and 2 is shown a longitudinal section through a motor driven chimney draft system according to the invention. The system has means, in this case a flange 110, for attaching the system to the outlet opening of a chimney.

Within a housing 111 the system has a flue gas impeller 10, which in this embodiment is an axial impeller with flue gas impeller blades 11 fixed to a flue gas impeller hub 12 on a hollow flue gas impeller shaft 13. When the flue gas impeller 10 is driven in rotation by a driving motor 100 in the housing, the flue gas impeller will create a draft in a downstream direction. When the system is attached to the flue gas outlet opening of a vertical chimney and in a position as shown in FIG. 1, the downstream direction is upwards, but other orientations are possible. A flue gas deflector disk 20 is situated downstream relative to the flue gas impeller 10 and is connected to the flue gas impeller 10 through the shaft 13 and the hub 12. When the flue gas impeller 10 is driven in rotation flue gas will be forced towards the flue gas deflector disk 20 where the flue gas will be deflected into a radial direction and leave the system through openings in the sides of the system. The flue gas deflector disk 20 has no openings and its connection to the hollow flue gas impeller shaft 13 is airtight.

The system has a motor 100 with a driving shaft 101. An end portion of the driving shaft 101 is received in a hub 102. The hub 102 is connected to an optional venting disk 30 at the downstream side of the flue gas deflector disk 20 and at an axial distance therefrom so as to define a space between the flue gas deflector disk 20 and the venting disk 30. The venting disk 30 has plurality of through-going openings 31, 32. The flue gas deflector disk 20 and the venting disk 30 are interconnected by a plurality of impeller blades 40 extending in a radial direction.

The motor 100 is fixed to a motor-bearing plate 103 which in turn is fixed to the housing 111. The motor-bearing plate 103 is situated between the motor and the venting disk 30 and has a central opening 104' receiving the hub 102 therethrough. Preferably, the central opening 104' has a larger diameter than the hub to provide an air passage. The peripheral edge portion of the venting disk 30 is angled away from the flue gas deflector disk 20 and towards the motor-bearing plate 103 leaving only a narrow slit therebetween.

When the system is installed at the outlet opening of a chimney and forced draft in the chimney is desired the motor 100 is activated. Hereby the motor drives in rotation the rotatable assembly of the hub 102, the venting disk 30, the impeller blades 40, the flue gas deflector disk 20, the shaft 13, the hub 12 and the flue gas impeller 10. When thus driven in rotation the flue gas impeller 10 will create a draft, or assist an insufficient thermal draft, in the chimney. Flue gases will be forced towards the flue gas deflector disk 20 and deflected into a radially outward direction and will leave the system through openings in the sides of the system.

When driven in rotation the assembly of the flue gas deflector disk 20, the venting disk 30 and the impeller blades 40 functions as a turbine which draws fresh air into the housing 111 through a peripheral slit 112 in the housing. Air in the housing will be drawn through openings 104, 104' in the motor-bearing plate 103 and towards the venting disk 30, through the openings 31 in the venting disk 30 and into the space between the venting disk 30 and the flue gas deflector disk 20 where the impeller blades 40 will force the air into a radially outward direction. Due to the angled edge portion of the venting disk 30 and the narrow slit between this portion and the motor-bearing plate 103 recirculation of air through the slit is minimised.

The turbine assembly of the flue gas deflector disk 20, the optional venting disk 30 and the impeller blades 40 can be produced and sold as a separate unit, with or without the flue gas impeller 10, that can be exchanged as a spare part or retrofitted as an upgrade of existing chimney draft systems.

The invention claimed is:

1. An impeller for a motor-driven chimney draft system, the impeller comprising:

a flue gas impeller for creating, in a flue gas passage, a draft in a flue gas downstream direction, a flue gas deflector disk for deflecting the flue gas, the flue gas deflector disk situated downstream relative to the flue gas impeller and connected to the flue gas impeller, a venting disk with venting holes therein and arranged at the downstream side of the flue gas deflector disk and at a distance therefrom so as to define a space between the flue gas deflector disk and the venting disk, impeller blades being arranged in the space between the flue gas deflector disk and the venting disk, the impeller blades directly connecting the flue gas deflector disk and the venting disk so as to establish a sole interconnection between the flue gas deflector disk and the venting disk, and a hub for connecting the impeller to an end portion of a driving shaft of a motor, the hub being connected to the venting disk, wherein the hub and the end portion of the driving shaft, when connected, are both situated downstream relative to the flue gas deflector disk, wherein the impeller, when rotating, draws flue gas downstream towards the flue gas deflector disk where it is deflected outwards in a radial direction and through openings in the sides of the system, thereby preventing the flue gases from contacting the driving shaft.

2. The impeller according to claim 1, wherein the flue gas deflector disk has a larger diameter than the venting disk.

3. The impeller according to claim 2, wherein a peripheral edge portion of the venting disk is angled away from the flue gas deflector disk.

4. The impeller according to claim 2, wherein:

the flue gas impeller is an axial impeller, and the flue gas impeller and the flue gas deflector disk are interconnected by a shaft with a space between the flue gas impeller and the flue gas deflector disk, the space constituting a flow path for flue gases.

5. A motor-driven chimney draft system, comprising:

an impeller according to claim 2; and a motor having a driving shaft, wherein an end portion of the driving shaft is connected to the hub.

6. The impeller according to claim 1, wherein a peripheral edge portion of the venting disk is angled away from the flue gas deflector disk.

7. The impeller according to claim 6, wherein:
the flue gas impeller is an axial impeller, and
the flue gas impeller and the flue gas deflector disk are interconnected by a shaft with a space between the flue gas impeller and the flue gas deflector disk, the space constituting a flow path for flue gases.

8. A motor-driven chimney draft system, comprising:
an impeller according to claim 6; and
a motor having a driving shaft, wherein an end portion of the driving shaft is connected to the hub.

9. The impeller according to claim 1, wherein:
the flue gas impeller is an axial impeller, and
the flue gas impeller and the flue gas deflector disk are interconnected by a shaft with a space between the flue gas impeller and the flue gas deflector disk, the space constituting a flow path for flue gases.

10. A motor-driven chimney draft system, comprising:
an impeller according to claim 9; and
a motor having a driving shaft, wherein an end portion of the driving shaft is connected to the hub.

11. A motor-driven chimney draft system, comprising:
an impeller according to claim 1; and
a motor having a driving shaft, wherein an end portion of the driving shaft is connected to the hub.

12. The chimney draft system according to claim 11, further comprising a motor-bearing plate fixed to the motor and situated between the motor and the impeller, the motor-bearing plate having a central opening receiving the driving shaft, and one or more openings allowing air to flow therethrough towards the impeller.

13. The chimney draft system according to claim 12, wherein the central opening allows air to flow therethrough towards the impeller.

14. The chimney draft system according to claim 12, wherein the system has means for attaching the system to a chimney.

15. The chimney draft system according to claim 11, wherein the system has means for attaching the system to a chimney.

16. The impeller according to claim 1, wherein the venting disk has a single opening and is connected to the hub via a flue gas impeller shaft at the single opening.

17. The impeller according to claim 1, wherein the flue gas impeller shaft has an airtight connection with the venting disk.

18. The impeller according to claim 1, wherein the impeller blades, when rotating, draws cool air through the venting holes and radially outward, thereby cooling the flue gas deflector disk.

* * * * *